US007234501B1

(12) United States Patent
Park

(10) Patent No.: US 7,234,501 B1
(45) Date of Patent: Jun. 26, 2007

(54) EXTERNAL BLIND ACTUATOR FOR SEALED DOUBLE GLAZED WINDOW

(76) Inventor: Hubert H. Park, 10022 Fallriver Ct., Fountain Valley, CA (US) 92708

( * ) Notice: Subject to any disclaimer, the term of this patent is extended or adjusted under 35 U.S.C. 154(b) by 0 days.

(21) Appl. No.: 11/445,985

(22) Filed: Jun. 2, 2006

(51) Int. Cl.
*E06B 3/38* (2006.01)

(52) U.S. Cl. ..... 160/107; 160/98; 160/90

(58) Field of Classification Search ..... 160/90, 160/98, 107, 178.1 R, 902, 903; 49/87.1, 49/86.1

See application file for complete search history.

(56) References Cited

U.S. PATENT DOCUMENTS

| | | | | | |
|---|---|---|---|---|---|
| 3,253,644 | A | | 5/1966 | Gotoh | |
| 3,703,920 | A | | 11/1972 | Debs | |
| 3,719,221 | A | * | 3/1973 | Hanson | 160/168.1 R |
| 4,194,550 | A | | 3/1980 | Hopper | |
| 5,048,245 | A | * | 9/1991 | Bresson et al. | 52/171.3 |
| 5,600,920 | A | * | 2/1997 | Roy | 49/64 |
| 5,699,845 | A | * | 12/1997 | Jelic | 160/107 |
| 5,826,638 | A | * | 10/1998 | Jelic | 160/107 |
| 6,070,638 | A | | 6/2000 | Jelic | |
| 6,397,917 | B1 | | 6/2002 | Levert | |
| 6,601,633 | B2 | | 8/2003 | Sun et al. | |
| 6,817,401 | B2 | | 11/2004 | Sun et al. | |
| 6,837,295 | B2 | | 1/2005 | Wang | |
| 2003/0075285 | A1 | * | 4/2003 | Anderson et al. | 160/90 |
| 2004/0011476 | A1 | * | 1/2004 | Schroder et al. | 160/107 |
| 2004/0069417 | A1 | * | 4/2004 | Sun et al. | 160/107 |
| 2004/0238131 | A1 | * | 12/2004 | Eveland et al. | 160/107 |

* cited by examiner

*Primary Examiner*—Blair M. Johnson
(74) *Attorney, Agent, or Firm*—Gordon K. Anderson

(57) ABSTRACT

An actuating mechanism (10) is taught that is used for externally operating a mini-blind (20) or a shade (20') in a sealed double glazed window (22) which includes a window frame (24) with a side opening (26) and a roll box (28) in alignment with the side opening. A blind actuator (34) incorporates a rotatably sealed pulley shaft (38) that interfaces with the roll box on an interior end (40) and a belt pulley (66) on an exterior end (42). The actuator is sealed to the window frame with an O-ring (48) and rotation of the belt pulley causes the blinds to raise, lower and tilt. When the actuator is slideably removed from the window frame the mini-blind cord roll box may be extricated for replacement or repair.

19 Claims, 5 Drawing Sheets

EXTERNAL BLIND ACTUATOR FOR SEALED DOUBLE GLAZED WINDOW

TECHNICAL FIELD

The present invention relates to sealed double glazed windows having blinds or shades inside in general. More specifically to an actuator mechanism that is mounted outside of the sealed interior permitting operational control as well as allowing the blinds or shades to be removed for replacement or repair.

BACKGROUND ART

Double pane windows have been popular for many years and are sealed to assure optimum heat transfer along with prevention of fogging and collection of dust. Double pane windows have also been developed that include mini-blinds of shades with this type commonly available in today's marketplace. When the double pane window includes this type of blind or shade the problem became how to seal the space between the panes and yet not compromise the air seal and yet be able to adjust the blind from the outside. Some prior art has used magnets one inside and one outside which function but not optimally.

Double pane windows are sealed to assure blocking heat transfer and outside noise. Further, blinds and shades enclosed in double glazed units are available either limited actuation mechanisms which are commonly magnetic handles. A magnetic actuation system is popular in the prior art.

A search directed toward a combination of the double pane window having the blind of shade inside sealed with the actuation of the blind provided by a mechanism that provides rotary movement to the blind device for raising and lowering the blades from the outside without affecting the seal. The prior art found did not disclose any patents that possess the novelty of the instant invention; however the following U.S. patents are considered related:

| Pat. No. | Inventor | Issue Date |
|---|---|---|
| 3,253,644 | Gotoh | May 31, 1966 |
| 3,703,920 | Debs | Nov. 28, 1972 |
| 4,194,550 | Hopper | Mar. 25, 1980 |
| 5,826,638 | Jelic | Oct. 27, 1998 |
| 6,070,638 | Jelic | Jun. 6, 2000 |
| 6,397,917 | Levert | Jun. 4, 2002 |
| 6,601,633 B2 | Sun et al. | Aug. 5, 2003 |
| 6,817,401 B2 | Sun et al. | Nov. 16, 2004 |
| 6,837,295 B2 | Wang | Jan. 4, 2005 |

Gotoh in U.S. Pat. No. 3,253,644 discloses a double pane window with enclosed folded or reel type blinds using magnets to operate the blinds vertically from an open to a closed position.

U.S. Pat. No. 3,703,920 issued to Debs is for a double pane window with enclosed blinds using cords to operate the blinds. Tilt and lift cords are connected to individual spool members of a cord operating unit.

Hopper in U.S. Pat. No. 4,194,550 discloses a double pane window with enclosed parallel sheets using a gear motor for operation. Spacers collapsible or nestable are mounted to separate each pair of adjacent sheets with the combination of dead air space and low emittance surface sheets impede heat transfer.

Jelic in U.S. Pat. No. 5,826,638 presents a window blind for use between double panes of glass with the blind having an outwardly curved top attached along front and back edges. The top has an opening through which tilt cords pass and the bottom has a hole for the ladder which is held in place with a rivet. The blind may also have a two piece head rail wherein one piece is plastic and the other pieces are metal to produce a thermal break.

U.S. Pat. No. 6,070,638 issued to Jelic teaches a double pane window that has a blind between the panes. A cord guide is provided in the top edge of the housing and has lift and tilt cords passing through a slot to operate the blinds. The blind may be raised, lowered and tilted while maintaining a seal between the window frame and the window panes.

Levert in U.S. Pat. No. 6,397,917 discloses a double pane window with enclosed blinds using an upper window with non-tilting fixed blades and the lower window using an electric motor hermetically sealed inside to operate the blinds.

U.S. Pat. No. 6,601,633 B2 of Sun et al. teach and insulated glass window with and integral blind assembly with corner keys which include pulley's for cords and a leg slideably retained between the frame and the glass to allow operation.

Sun et al. in U.S. Pat. No. 6,817,401 B2 disclose a retrofit blind for a doorlight which includes a blind actuator with gears and a toothed belt. The mounting system includes a pair of movable catches on the frame that may be locked behind the doorlight to secure the lower end of the assembly.

U.S. Pat. No. 6,837,295 of Wang is for a double pane window with enclosed blinds using a magnetic tilt mechanism to operate the blinds. Two magnet pieces are separated from the glass with the rotation of the outside piece causing the internal piece to likewise rotate without affecting the insulation properties of the double pane window.

DISCLOSURE OF THE INVENTION

As described previously double pane windows are extremely popular in today's marketplace as they have the ability to create an effective thermal and noise barrier. When the panes are sealed together another problem arose when the blinds or shades were added inside the sealed area. The answer was to use a mechanism completely inside the space itself and magnets were used to slide the actuator up and down. While this approach works it is not entirely satisfactory as mini-blinds historically use cords that are rolled up on a spool which have the propensity to become tangled or break requiring the entire window to be scraped as there was no way to easily breach the seal and replace or repair the blinds without completely removing the window and replacing the factory seal.

Despite the advantages and popularity of the magnetic systems there is room for improvement. In the first place the magnetic systems are unreliable because inside magnets and outside magnets can be separated and get lost. Secondarily the use of a magnet leaves a dark magnetic stain on its traveling track. Thirdly to sustain weight the choice of a magnetic may be limited and may not the optimum strength. Lastly a magnetic system must use tempered glass to function properly which increases the overall cost considerably.

It is therefore the primary object of the invention to solve this long felt need by locating the actuating mechanism on the outside of the sealed area that is between the glazing with the utilization of a shaft that penetrates the sealed area on one end and permits a conventional functional operation on the other end. This novel feature uses O-rings as the sealing media with the shaft penetrating a stationary hub. The use of magnets may be eliminated completely which have their limitations in transmitting force in the event of binding of the cords or connecting apparatus.

An important object of the invention is a feature that may be combined with the use of a shaft penetrating the sealed area permitting the entire mini-blind and cord roll box to be removed and repaired or replaced easily. This feature is accomplished by the use of a rigid plate with an O-ring seal covering a side opening in the window frame large enough for blind removal; further this plate also provides a mounting surface for the shaft and its rotating seal.

Another object of the invention is that this approach leads to an easy method of blind removal through the side opening in the window frame using a simple modification of existing blind cord roll boxes and the combination of a slot and a T-rail in the window frame. With this arrangement the roll box and attached blinds are simply slid out linearly and are encased until completely removed.

Still another object of the invention allows the use of a time proven and reliable method of controlling the position of the blinds. In the event of a malfunction of the external operating mechanism the window may be removed and the plate covering the end detached allowing access to the mechanism for repair or replacement without breaking the glazing seal.

Yet another object of the invention is that it is cost effective as the components required are simple to manufacture using existing methods and modification to conventional structure is easily made. Once the tooling cost is amortized the piece part will be relatively inexpensive due to the economies of number.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
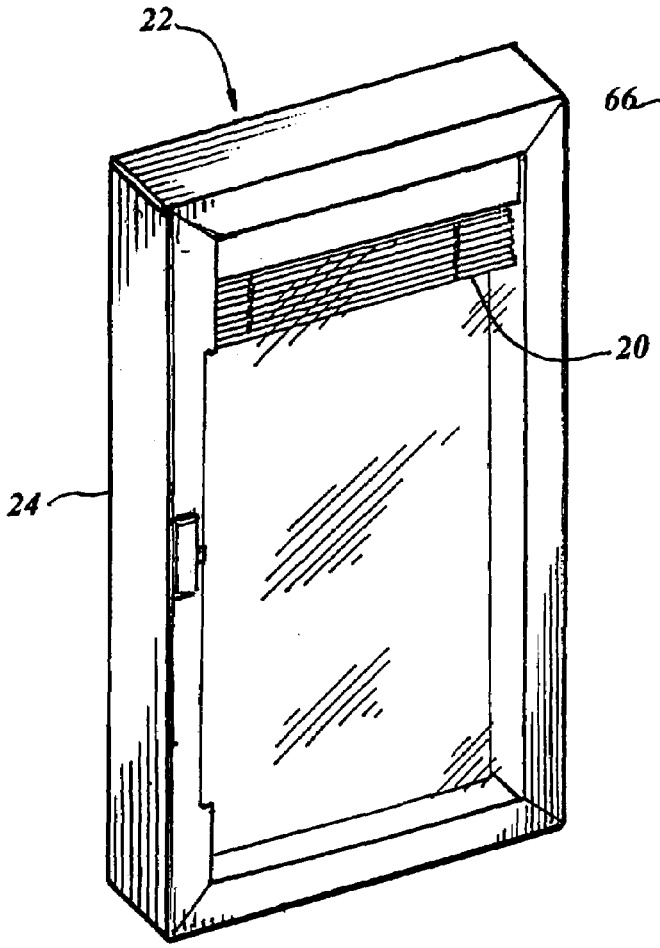
FIG. 1 is a partial isometric view of a double glazed window with the actuating mechanism installed within the frame but outside of the glazing in the preferred embodiment.
Figure 18:
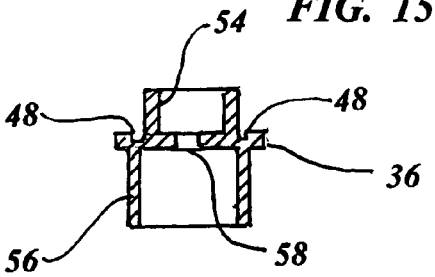
FIG. 18 is a cross sectional view taken along lines 18-18 of FIG. 14
Figure 30:
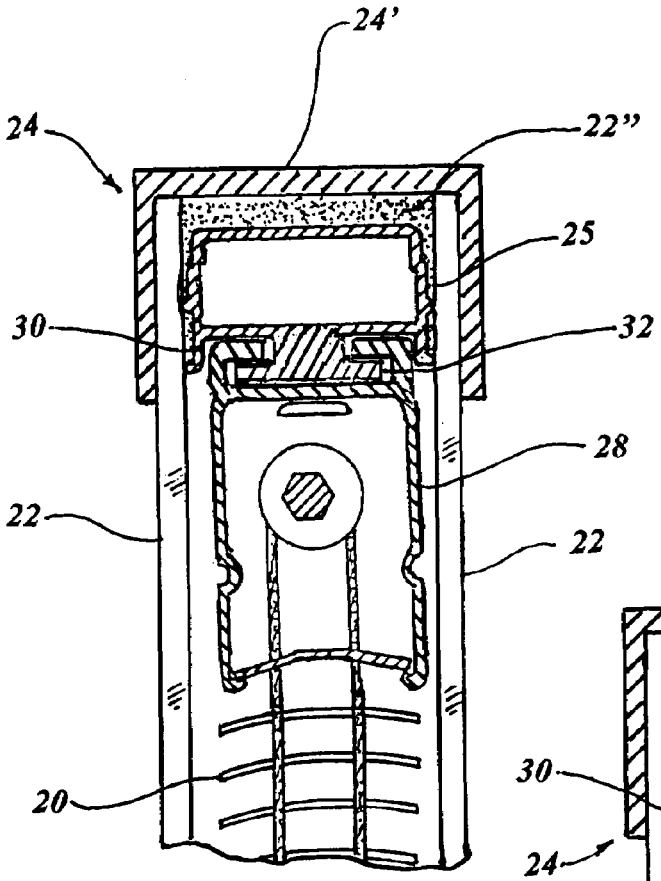
FIG. 30 is a cross sectional view taken along lines 30-30 of FIG. 21 illustrating the spacer having an integral inverted T-rail in its underside surface and the roll box having an integral inverted slot on its inside top surface and a mini-blind.
Figure 31:
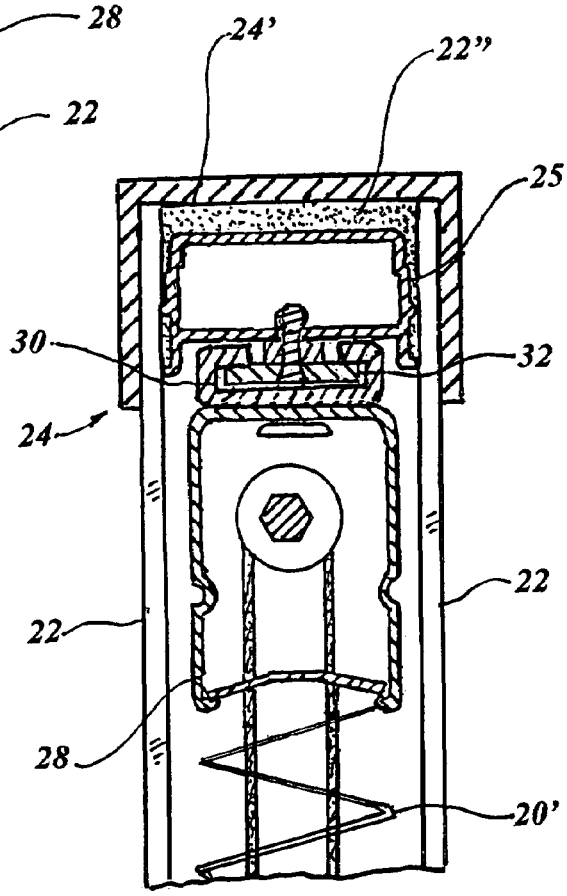
FIG. 31 is a cross sectional view taken along lines 31-31 of FIG. 21 illustrating the spacer having an attached inverted T-rail in its underside surface and the roll box having an attached inverted slot on its inside top surface and a paper shade.

The best mode for carrying out the invention is presented in terms of a preferred embodiment of a blind actuating mechanism 10 for externally operating a mini-blind 20 or a paper shade 20' in a sealed double glazed window 22. This preferred embodiment is shown in FIGS. 1 thorough 31 and is comprised of an assemblage that incorporates a side opening 26 therethrough. The sealed double glazed window 22 consists in detail of a window frame 24 consisting of a channel frame 24" covering the peripheral edges and a channel shaped extrusion 24" on a first vertical side with spacers 25 on the top, bottom and second vertical side. Double glass panes 22' are adhered to the spacers 25 and extrusion 24" with sealant 22" on contiguous surfaces, as shown in FIGS. 30 and 31. The double glazed window 22 may contain an inert gas such as Argon within the sealed double glazing to prevent pressure differential conditions at various altitudes. The window frame side opening 26 is in the channel shaped extrusion 24" and is configured to permit a roll box 28 to be removed intact therethrough, as illustrated in FIG. 18. This roll box 28 may incorporate either a mini-blind 20 or a paper shade 20' with the mini-blind 20 illustrated in FIGS. 1, 2, 19, 21 and 30 and the shade 20' in FIG. 31.

Figure 22:
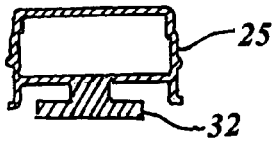
FIG. 22 is a cross sectional view taken along lines 24-24 of FIG. 19 illustrating the spacer having an integral inverted T-rail in its top surface.
Figure 23:
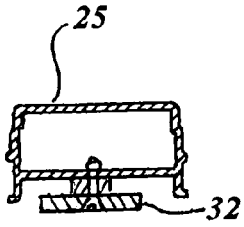
FIG. 23 is a cross sectional view taken along lines 25-25 of FIG. 19 illustrating the spacer having an inverted T-rail attached to its top surface.

The roll box 28 is slideably disposed onto a bottom portion of the spacer 25 in alignment with the side opening 26. In order to slide efficiently the roll box 28 includes a slot 30 on its top surface and the spacer 25 includes an inverted T-rail 32 on the mating surface interfacing with the slot 30. This arrangement permits the roll box 28 to freely slide through the side opening 26 of the channel shaped extrusion 24" while being stabilized throughout its travel as the union is not broken until complete removal is achieved. FIGS. 22, 23, 26 and 27 depict this arrangement with the slot 30 integrally formed in the roll box 28 itself in FIG. 26 or attached thereto in FIG. 27. The T-rail 32 may be integrally formed in the spacer 25, as shown in FIG. 22 or attached in FIG. 23.

Figure 24:
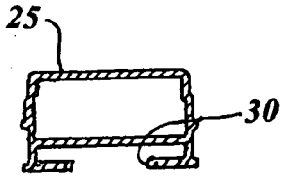
FIG. 24 is a cross sectional view taken along lines 22-22 of FIG. 19 illustrating the spacer having an integral slot in its top surface.
Figure 25:
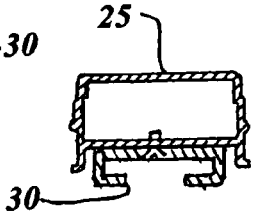
FIG. 25 is a cross sectional view taken along lines 23-23 of FIG. 19 illustrating the spacer having a slot member attached to its top surface.
Figure 26:
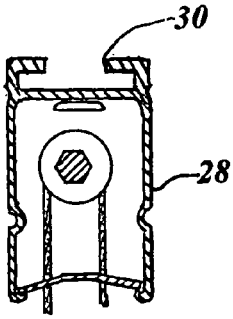
FIG. 26 is a cross sectional view taken along lines 28-28 of FIG. 20 illustrating the roll box having an integral inverted slot on its inside top surface.
Figure 27:
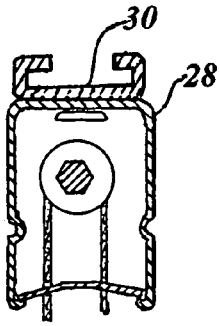
FIG. 27 is a cross sectional view taken along lines 29-29 of FIG. 20 illustrating the roll box having an inverted slot attached to its top surface.
Figure 28:
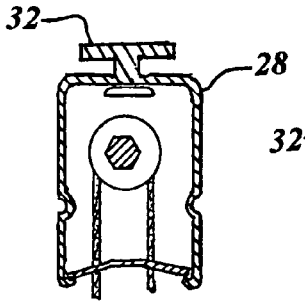
FIG. 28 is a cross sectional view taken along lines 26-26 of FIG. 20 illustrating the roll box having an integral inverted T-rail on its inside surface.
Figure 29:
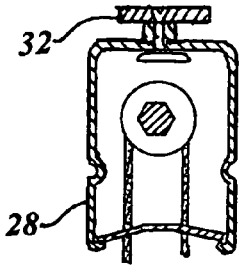
FIG. 29 is a cross sectional view taken along lines 27-27 of FIG. 20 illustrating the roll box having an inverted T-rail attached to its top surface.

While the above arrangement is preferred the reverse may be equally suitable with the roll box 28 having the T-rail 32 on its top surface and the spacer 25 having the slot 30 inverted on a mating surface therefore interfacing with the T-rail 32 on the roll box 28 permitting the same functional operation. The T-rail 32 may be integrally formed in the roll box 28 itself in FIG. 28 or attached thereto in FIG. 29. Likewise the slot 30 may be integrally formed in the spacer 25, as shown in FIG. 24 or attached in FIG. 25.

In order to achieve the ability of the invention to permit operation of the mini-blind 20 or shade 20' from the outside of the sealed space between the double panes of the window 22, a blind actuator 34 is utilized. This actuator 34 is illustrated in FIGS. 4-9 and includes a flat mounting plate 36 configured to cover the side opening 26 in the channel shaped extrusion 24" with a rotatably sealed pulley shaft 38 penetrating therethrough. The shaft 38 is configured to include a shaft interior end 40 and a shaft exterior end 42 with the interior end 40 interfacing with the roll box 28.

Figure 19:
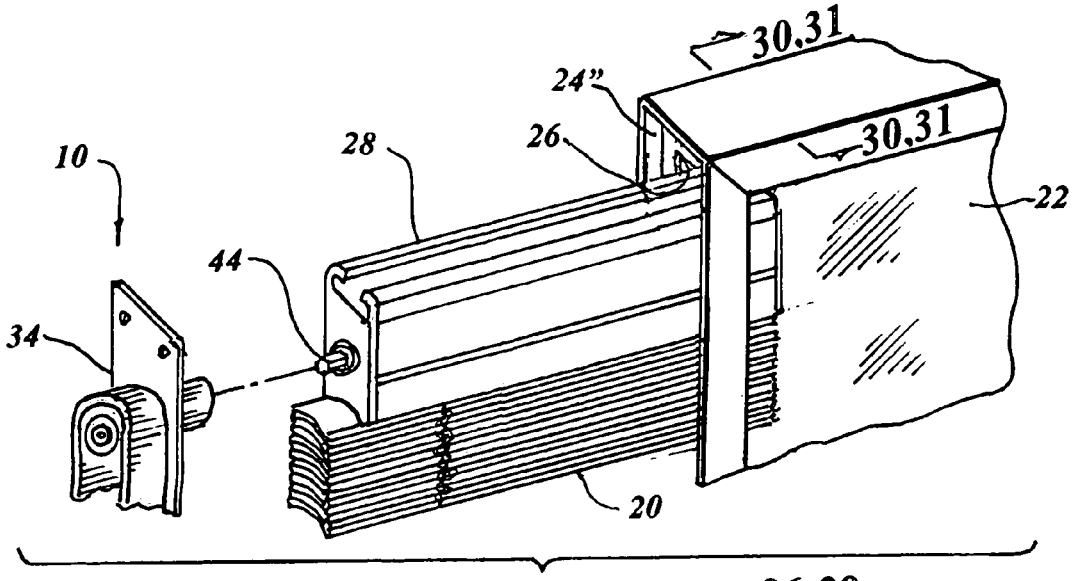
FIG. 19 is an exploded isometric view of the blind actuator and mini-blind cord roll box partially removed through the side opening in the window frame.
Figure 20:
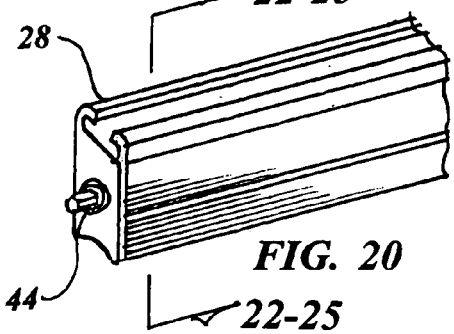
FIG. 20 is a partial isometric view of the mini-blind cord roll box illustrating various slideable dispositions of the roll box structure.
Figure 21:
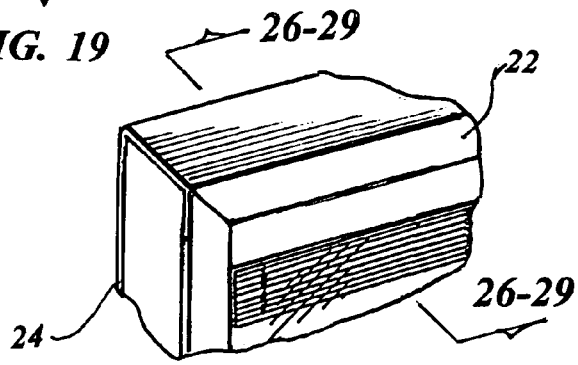
FIG. 21 is a partial isometric view of the window frame in the preferred embodiment with its sectional views illustrating various slideable dispositions of the frame structure.

The roll box 28 has a hexagonal shaft 44 extending therefrom, as illustrated in FIGS. 19 and 20 for operation and positioning integral mini-blinds 20 in an up and down orientation and angular tilt or the blind 20' up and down. The actuator pulley shaft 38 includes a hexagonal cavity 46 on its interior end 40 and is configured to interface with the hexagonal shaft 44 of the roll box 28 as depicted in FIG. 19.

Figure 8:
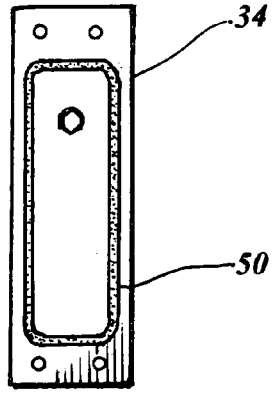
FIG. 8 is a rear view of the blind actuator in the preferred embodiment.
Figure 16:
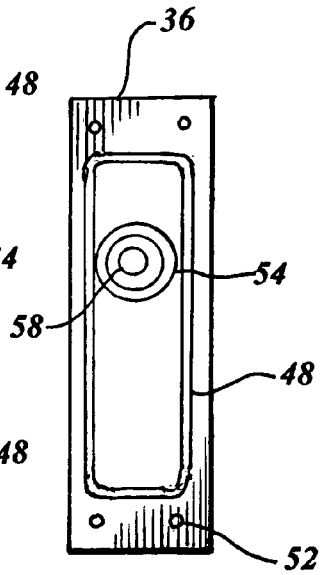
FIG. 16 is a rear elevation view of the flat mounting plate of the blind actuator in the preferred embodiment.
Figure 13:
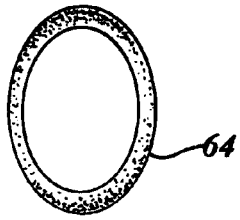
FIG. 13 partial isometric view of one of shaft O-rings for the pulley shaft.
Figure 17:
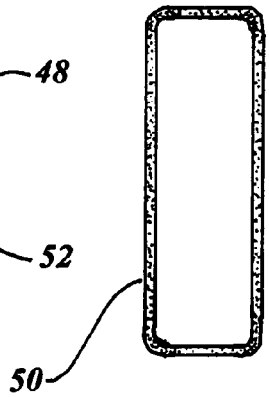
FIG. 17 front view of the mounting plate O-ring in the preferred embodiment.

The mounting plate 36 has a plate O-ring groove 48 therein adjacent to the plate's peripheral edge with an O-ring 50 disposed therein, as shown in FIGS. 8, 16 and 17. A plurality of fasteners, not shown, penetrate mounting holes 52 in the mounting plate 36 and into channel shaped extrusion 24" compressing the O-ring 50 therebetween creating a hermetic seal around the side opening 26.

The mounting plate 36 includes an integral pulley shaft hub 54 positioned on an inside surface forming a cylindrical cavity within to interface with the pulley shaft 38. An integral protective wall 56 is located on an outside surface of the plate 36 and is configured in an inverted U-shape as illustrated in FIGS. 4-7, 915 and 18. A through hole 58 is centrally located between shaft hub 54 and the protective wall 56 permitting the pulley shaft 38 to penetrate completely through the mounting plate 36. A compression washer 60 is positioned on each side of the through hole 58 retaining the pulley shaft 38 within the mounting plate 36 in a rotatable manner. The mounting plate 36 is depicted pictorially in FIGS. 14-18 by itself alone and may be made of a material such as thermoplastic or metal.

Figure 9:
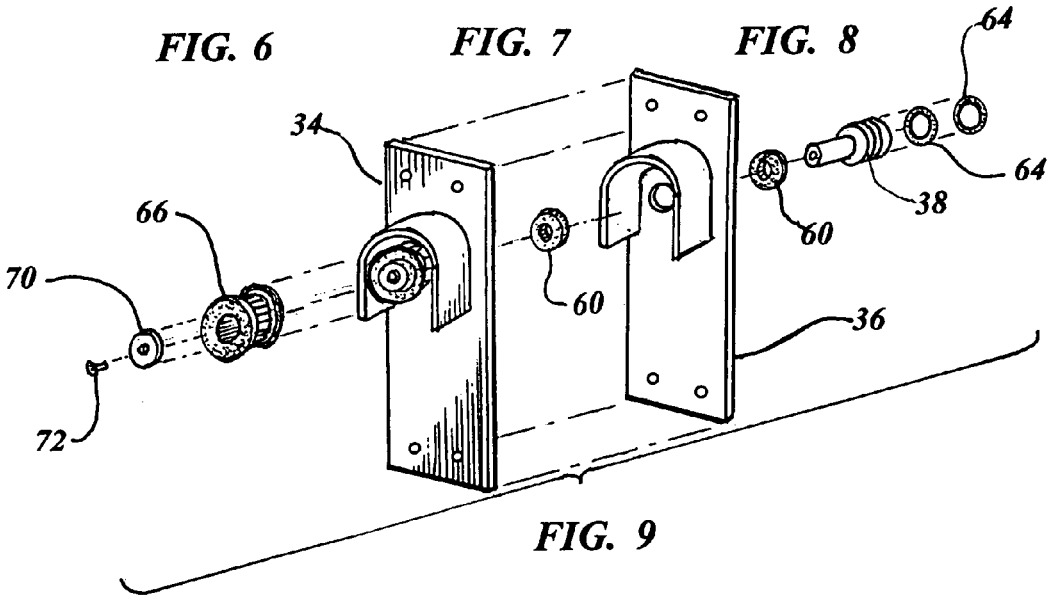
FIG. 9 is an exploded isometric view of the blind actuator in the preferred embodiment.
Figure 10:
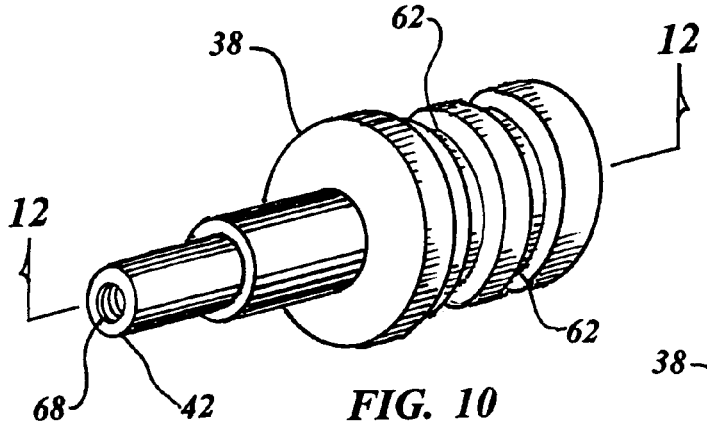
FIG. 10 is a partial isometric view of the pulley shaft in the preferred embodiment completely removed from the actuator for clarity.
Figure 11:
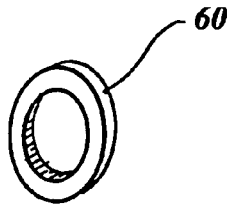
FIG. 11 partial isometric view of one of compression washers of the blind actuator for holding the pulley shaft in place on both sides of the flat mounting plate.
Figure 12:
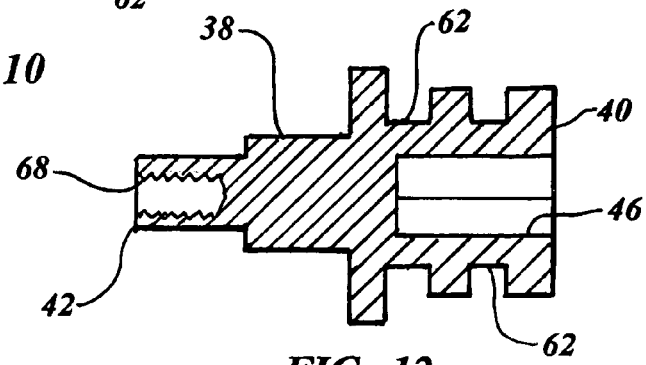
FIG. 12 is a cross sectional view taken along lines 12-12 of FIG. 10.
Figure 14:
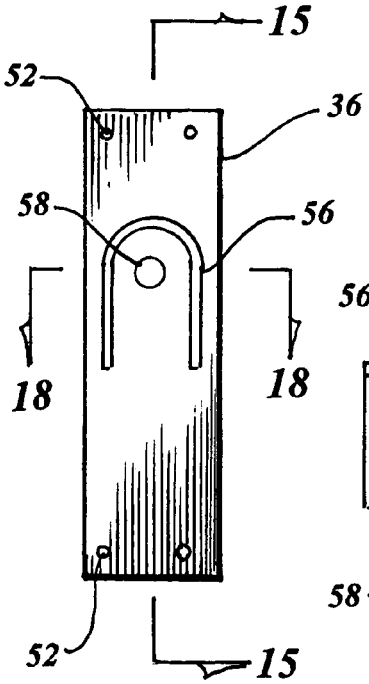
FIG. 14 is a front elevation view of the flat mounting plate of the blind actuator in the preferred embodiment.
Figure 15:
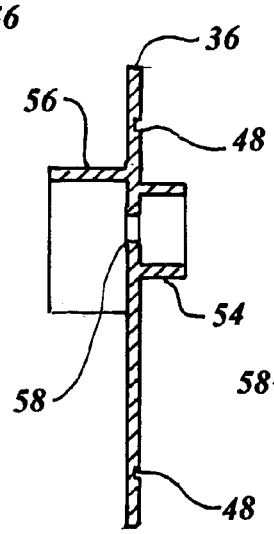
FIG. 15 is a cross sectional view taken along lines 15-15 of FIG. 14.

The pulley shaft 38 is illustrated in FIGS. 9, 10 and 12 which includes at least one shaft O-ring groove 62 therein with at least one shaft O-ring 64 disposed therein; however two are preferred as shown. When the shaft 38 is positioned within both the through hole 58 and the pulley shaft hub 54, the O-rings compress onto an inside surface of the hub 54 creating a seal maintaining a vapor tight barrier when stationary or rotated.

Figure 2:
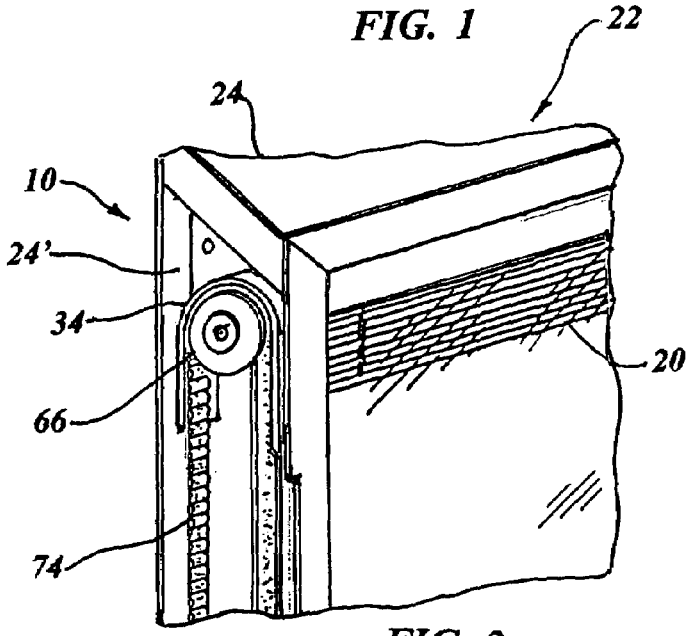
FIG. 2 is a fragmentary partial isometric view of the blind actuator mounted to the window frame covering the side opening with the frame side cover removed and a belt attached to a belt pulley.
Figure 3:
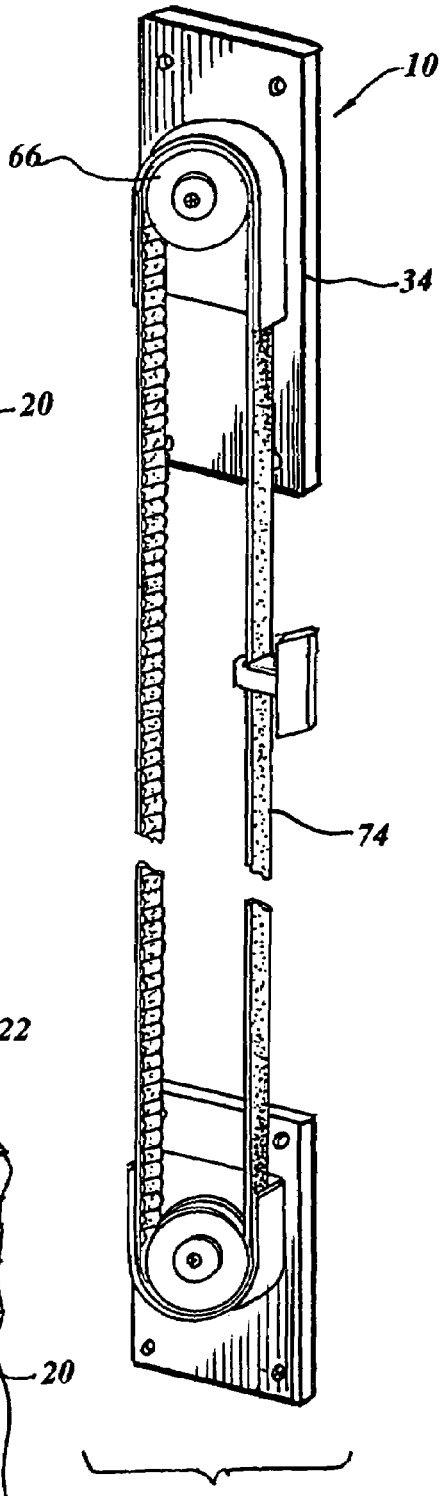
FIG. 3 is a fragmentary view of the blind actuator completely removed from the window frame with the belt attached to the belt pulley and the belt wrapped around a conventional wheel.
Figure 4:
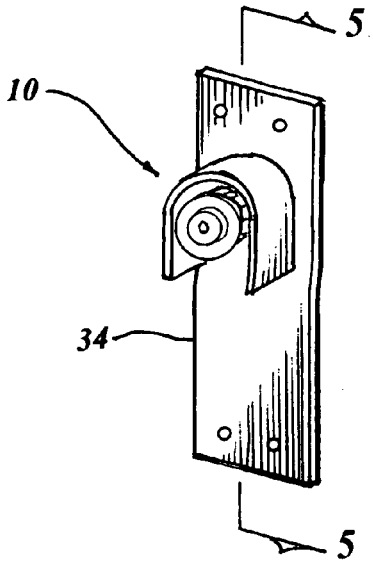
FIG. 4 is a partial isometric view of the blind actuator in the preferred embodiment, completely removed from the invention for clarity.
Figure 5:
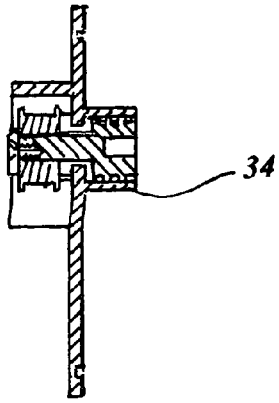
FIG. 5 is a cross sectional view taken along lines 5-5 of FIG. 4.
Figure 6:
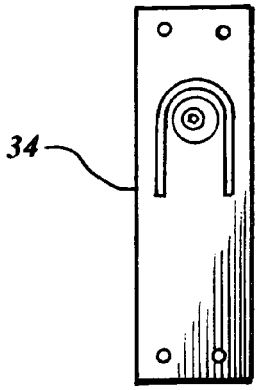
FIG. 6 is a front elevation view of the blind actuator in the preferred embodiment.
Figure 7:
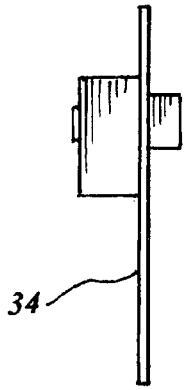
FIG. 7 is a right side view of the blind actuator in the preferred embodiment.

A belt pulley 66 is attached to the shaft exterior end 42 and when rotated the interior end 40 causes the shade cord roll box 28 to raise, lower and tilt the mini-blind 20 and when the actuator 10 is removed, the roll box 28 may be slideably extricated for replacement or repair as shown in FIG. 19. The exterior end 40 of the pulley shaft 38 incorporates a tapped hole 68 and a pulley retainer 70 intimately engages the pulley 66 with a threaded screw 72 in the tapped hole 68 urging the pulley against the shaft 38, as depicted in the exploded view of FIG. 9. The belt pulley 66 has a toothed profile configured to mate with a conventional synchronous belt 74, as shown in FIGS. 2 and 3.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. An actuating mechanism externally operating a window covering in a sealed double glazed window which comprises:

said window having a frame, with the frame having a side opening in an upper portion of a side member of the frame, and a window covering roll box disposed within the frame in alignment with the side opening, and a roll box actuator comprising a plate for sealing the side opening having a rotatably sealed pulley shaft extending therethrough interfacing with the roll box on an interior end thereof inside the sealed window and a belt pulley on an exterior end outside of the sealed window with the actuator sealed to the window side opening wherein rotation of the pulley raises or lowers the window covering, wherein the actuator is removable and the roll box may be slidably removed or inserted.

2. An actuating mechanism externally operating a window covering in a sealed double glazed window which comprises:

said sealed double pane window having a frame, with the frame having a side opening in an upper portion of a side member of the frame, a window covering roll box slideably disposed within the window frame in alignment with the side opening, a window covering actuator comprising a plate for sealing the side opening having a rotatably sealed pulley shaft extending therethrough with the shaft having a shaft interior end thereof inside the sealed window and a shaft exterior end outside of the sealed window and the actuator sealably covering the side opening with the interior end of the pulley shaft interfacing with the roll box, and a belt pulley attached to the shaft exterior end such that when the belt pulley is rotated the interior end of the shaft causes the roll box to raise or lower the wherein when the actuator is removed the roll box may be slideably removed or inserted.

3. An actuating mechanism externally operating a window covering in a sealed double glazed window which comprises:

said sealed double pane window having a frame, with the frame having a side opening in an upper portion of a side member of the frame.

a window covering roll box slideably disposed within the window frame in alignment with the side opening, a window covering actuator comprising a plate for sealing the side opening having a rotatable sealed pulley shaft extending therethrough with the shaft having a shaft interior end thereof inside the sealed window and a shaft exterior end outside of the sealed window and the actuator sealably covering the side opening with the interior end of the pulley shaft interfacing with the roll box, said pulley shaft having a tapped hole in the exterior end and a belt pulley attached to the shaft exterior end such that when the belt pulley is rotated the interior end of the shaft causes the roll box to raise, lower or the wherein when the actuator is removed the roll box may be slideably removed or inserted.

4. The actuating mechanism as recited in claim 3 wherein said window frame further comprises an inert gas within the sealed double glazing to preclude internal fogging and prevent pressure differential conditions at various altitudes.

5. The actuating mechanism as recited in claim 3 wherein said window frame side opening is configured to permit the roll box to be removed intact through the side opening.

6. The actuating mechanism as recited in claim 3 wherein said roll box slideable disposition within the window frame is defined as said roll box having a slot on a top surface and a spacer in the window frame having an inverted T-rail on a mating surface interfacing with the slot on the roll box permitting the roll box to freely slide through the side opening of the window frame.

7. The actuating mechanism as recited in claim 3 wherein said roll box slideable disposition within the window frame is defined as said roll box having a T-rail on a top surface and a spacer in the window frame having an inverted slot on a mating surface interfacing with the T-rail on the roll box permitting the roll box to freely slide through the side opening of the window frame.

8. The actuating mechanism as recited in claim 3 wherein said roll box further having a hexagonal shaft extending therefrom for operation and positioning integral mini-blinds or shade.

9. The actuating mechanism as recited in claim 8 wherein said roll box actuator pulley shaft further having a hexagonal cavity on the interior end configured to interface with the hexagonal shaft of the mini-blind cord roll box.

10. The actuating mechanism as recited in claim 3 wherein said roll box actuator further comprises a flat mounting plate configured to cover said side opening in the window frame.

11. The actuating mechanism as recited in claim 10 wherein said mounting plate further having a plate O-ring groove therein adjacent to the plate's peripheral edge with an O-ring disposed therein, and a plurality of fasteners penetrating the mounting plate and the window frame compressing the O-ring therebetween creating a hermetic seal around the side opening in the frame.

12. The actuating mechanism as recited in claim 10 wherein said mounting plate further comprises an integral pulley shaft hub positioned on an inside surface thereof, with a cylindrical cavity within the hub.

13. The actuating mechanism as recited in claim 10 wherein said mounting plate further comprises an integral protective wall on an outside surface thereof, with the protective wall configured in an inverted U-shape.

14. The actuating mechanism as recited in claim 10 wherein said mounting plate further comprises a material selected from the group consisting of thermoplastic and metal.

15. The actuating mechanism as recited in claim 10 wherein said mounting plate further having a through hole therein permitting the pulley shaft to penetrate completely through the mounting plate.

16. The actuating mechanism as recited in claim 15 further comprising a compression washer on each side of the through hole retaining the pulley shaft to the mounting plate in a rotatable manner.

17. The actuating mechanism as recited in claim 3 wherein said pulley shaft further having at least one shaft O-ring groove therein with at least one shaft O-ring disposed within the O-ring groove.

18. The actuating mechanism as recited in claim 3 further comprising a pulley retainer and a threaded screw with the belt pulley positioned upon the pulley shaft and the pulley retainer intimately engaging the pulley with the threaded screw disposed within the tapped hole in the pulley shaft urging the pulley against the actuator.

19. The actuating mechanism as recited in claim 3 wherein said belt pulley further having a toothed profile configured to mate with a synchronous belt.

* * * * *